US010465859B2

(12) United States Patent
Wen et al.

(10) Patent No.: US 10,465,859 B2
(45) Date of Patent: Nov. 5, 2019

(54) TUBULAR ILLUMINATING DEVICE HAVING AN INTEGRATED DRIVE AND LIGHTING UNIT AND METHOD OF ASSEMBLING THE TUBULAR ILLUMINATING DEVICE

(71) Applicant: LEDVANCE GmbH, Garching bei Munchen (DE)

(72) Inventors: Haitao Wen, Guangdong (CN); Jun Liu, Guangdong (CN); Xiongqiang He, Guangdong (CN); Shijun Nie, Guangdong (CN)

(73) Assignee: LEDVANCE GMBH, Garching bei Munich (DE)

( * ) Notice: Subject to any disclaimer, the term of this patent is extended or adjusted under 35 U.S.C. 154(b) by 0 days.

(21) Appl. No.: 15/758,841

(22) PCT Filed: Sep. 12, 2016

(86) PCT No.: PCT/EP2016/071412
§ 371 (c)(1),
(2) Date: Mar. 9, 2018

(87) PCT Pub. No.: WO2017/042379
PCT Pub. Date: Mar. 16, 2017

(65) Prior Publication Data

US 2019/0211976 A1 Jul. 11, 2019

(30) Foreign Application Priority Data

Sep. 11, 2015 (CN) ..... 2015 1 0580671

(51) Int. Cl.
*F21K 9/278* (2016.01)
*F21V 23/06* (2006.01)
(Continued)

(52) U.S. Cl.
CPC ..... *F21K 9/278* (2016.08); *F21K 9/90* (2013.01); *F21V 19/005* (2013.01);
(Continued)

(58) Field of Classification Search
CPC ..... F21K 9/278; F21K 9/90; F21V 23/005; F21V 23/06; F21V 19/005; F21Y 2115/10; F21Y 2103/10
See application file for complete search history.

(56) References Cited

U.S. PATENT DOCUMENTS 10,158,205 B2 * 12/2018 Wen ..... F21K 9/272
10,267,500 B2 * 4/2019 He ..... F21V 23/003
(Continued)

FOREIGN PATENT DOCUMENTS

CN 202733534 U 2/2013
CN 103899939 A 7/2014
WO 2010035986 A2 4/2010

*Primary Examiner* — Tracie Y Green
(74) *Attorney, Agent, or Firm* — Hayes Soloway PC

(57) ABSTRACT

The present invention relates to an illuminating device and a method of assembling the illuminating device, wherein the illuminating device comprises a tubular casing, an electrical connector connected with the casing, a drive unit at least partially received in the electrical connector, and a light-emitting unit received in the casing, wherein the light-emitting unit comprises a carrier, wherein the electronic parts of the drive unit and the light-emitting parts of the light-emitting unit are arranged on the carrier.

20 Claims, 1 Drawing Sheet

(51) Int. Cl.

| | |
|---|---|
| ***F21K 9/90*** | (2016.01) |
| ***F21V 19/00*** | (2006.01) |
| ***F21V 23/00*** | (2015.01) |
| *F21V 15/015* | (2006.01) |
| *F21Y 103/10* | (2016.01) |
| *F21Y 115/10* | (2016.01) |

(52) U.S. Cl.
CPC ..... *F21V 23/005* (2013.01); *F21V 23/06* (2013.01); *F21V 15/015* (2013.01); *F21Y 2103/10* (2016.08); *F21Y 2115/10* (2016.08)

(56) References Cited

U.S. PATENT DOCUMENTS

| | | | |
|---|---|---|---|
| 2010/0046222 | A1 | 2/2010 | Yang |
| 2013/0170196 | A1 | 7/2013 | Huang et al. |
| 2015/0029734 | A1 | 1/2015 | Ko et al. |

* cited by examiner

TUBULAR ILLUMINATING DEVICE HAVING AN INTEGRATED DRIVE AND LIGHTING UNIT AND METHOD OF ASSEMBLING THE TUBULAR ILLUMINATING DEVICE

CROSS-REFERENCE TO RELATED APPLICATION AND PRIORITY

This patent application is a U.S. National Stage of International Patent Application No. PCT/EP2016/071412 filed on Sep. 12, 2016, which claims priority from Chinese Patent Application No. 201510580671.4 filed on Sep. 11, 2015. Each of these patent applications is herein incorporated by reference in its entirety.

TECHNICAL FIELD

The present invention relates to an illuminating device and a method of assembling the illuminating device.

BACKGROUND ART

The conventional fluorescent lamps allow the fluorescent powder to emit visible light by means of the ultraviolet light released in the lamp tube after energized. The common fluorescent lamps include the straight tube fluorescent lamps and the annular fluorescent lamps, wherein the straight tube fluorescent lamps can be designed with varied tube diameters. T5 straight fluorescent lamps have relatively ideal illumination effects to the colorful objects and environments, with a low luminous failure and a long service life, and are suitable for use in the colorful circumstances. In comparison, T8 straight fluorescent lamps have good luminance, save energy, have a long service life, and are suitable for the circumstances with plain colors but high demand to luminance.

In order to further save the energy consumption and ensure the luminance of the illuminating device, the LED lamp tubes are designed on the basis of the conventional fluorescent lamps. The light source of the LED lamp tubes uses a light emitting diode as a light-emitting body, which not only retains the tubular outline of the conventional fluorescent lamp, but also has higher light effect, saves more energy, has a longer service life, and is more environment-friendly. The LED lamp tubes have the same outline, size, and diameter as the conventional fluorescent lamps, and also include for example T5 lamp tubes and T8 lamp tubes. The LED lamp tubes are quite easy to install, and in installation, the original fluorescent lamp is removed, the LED lamp tube is placed, and the ballast and the starter are removed. However, the LED lamp tubes currently used, especially T5 lamp tubes, have to be designed to be externally driven as the space of the lamp tube is not big enough, which not only complicates the structure of the LED lamp tubes, but also increases the manufacture cost of the LED lamp tubes.

SUMMARY OF THE INVENTION

In order to solve the above-mentioned technical problems, the present invention proposes a novel illuminating device and a method for assembling this illuminating device. A drive unit and a light-emitting unit of the illuminating device according to the present invention can be integrated together by sharing the same single circuit board, thus, the illuminating device has a more compact structure and good integrity, moreover, the illuminating device according to the present invention is easier to assembly, and has a lower manufacture cost.

One of the objects of the present invention is achieved by such an illuminating device that comprises a tubular casing, an electrical connector connected with the casing, a drive unit at least partially received in the electrical connector, and a light-emitting unit received in the casing, wherein the light-emitting unit comprises a carrier, wherein the electronic parts of the drive unit and the light-emitting parts of the light-emitting unit are arranged on the carrier.

The drive unit and the light-emitting unit of the illuminating device according to the present invention share the same carrier such that all of the electronic parts of the drive unit and the light-emitting parts of the light-emitting unit are mounted on the carrier, thus, the electrical connector can supply power to the drive unit and the light-emitting unit through the same carrier. Besides, the electronic parts of the drive unit mounted on the carrier also can be partially received in the casing of the illuminating device, but do not have to be completely received I the electrical connector.

According to a preferred embodiment of the present invention, the electronic parts include a first type of parts and a second type of parts, wherein the first type of parts have a greater volume than the second type of parts, wherein the first type of parts and the second type of parts are at least partially received in the electrical connector. According to the illuminating device of the present invention, the electronic parts of the drive unit of the illuminating device do not need to be completely received in the electrical connector, instead, they can be for example partially received in the electrical connector and partially received in the casing. Therefore, the electronic parts of the drive unit can make full use of the inner space of the illuminating device such that the inner structure of the illuminating device is more compact.

According to a further preferred embodiment of the present invention, the first type of parts and the light-emitting parts are mounted on a first side of the carrier, and the second type of parts are mounted on a second side of the carrier opposite to the first side. The light-emitting parts can thus be mounted in the space defined by the first type of parts and the casing, and a predetermined distance of the light-emitting parts to an exit surface of the casing is realized.

According to a preferred embodiment of the present invention, the second type of parts and the light-emitting parts are mounted on a first side of the carrier, and the first type of parts are mounted on a second side of the carrier opposite to the first side. The light-emitting parts can thus be mounted in a space defined by the second type of parts and the casing, and another predetermined distance of the light-emitting parts to an exit surface of the casing is realized.

According to a further preferred embodiment of the present invention, the illuminating device further comprises a first connecting element arranged on the carrier for fixing one side of the carrier on an inner wall of the casing. The first connecting element is used to fix the carrier mounted with the electronic parts of the drive unit and the light-emitting parts of the light-emitting unit within the casing.

According to a preferred embodiment of the present invention, the first connecting element is configured as an adhesive structure, wherein the adhesive structure connects the other side of the carrier which is opposite to the one side mounted with the light-emitting parts on the inner wall. The adhesive structure provides a manner of manufacturing the illuminating device at a low cost, and can fix the carrier within the casing simply and effectively.

According to a preferred embodiment of the present invention, the illuminating device further comprises a second connecting element arranged within the electrical connector for electrically connecting the carrier and the electrical connector. The electrical connector supplies power to the carrier through the second connecting element, and the carrier can simultaneously supply power to the drive unit and the light-emitting unit mounted thereon.

According to a further preferred embodiment of the present invention, the second connecting element can be pressed against the carrier in an elastic deformable manner to form electrical connection of the electrical connector and the carrier. This thus allows the carrier, upon insertion into the electrical connector, is supplied with power through direct elastic contact with the second connecting element, without manually connecting the carrier with the second connecting element or welding an electrical contact of the electrical connector on the carrier.

According to a further preferred embodiment of the present invention, the first type of parts comprises a relay and a capacitor, and the second type of parts comprises a resistor, an integrated chip and an inductor.

The other object of the present invention is achieved by a method for assembling the illuminating device as mentioned above, wherein the method includes: providing a carrier for light-emitting parts of a light-emitting unit of the illuminating device; arranging electronic parts of a drive unit of the illuminating device on the carrier; inserting the carrier mounted with the light-emitting parts and the electronic parts into a casing of the illuminating device, and fixing the carrier on an inner wall of the casing using a first connecting element; mounting an electrical connector of the illuminating device on the casing such that the carrier is inserted into the electrical connector and is electrically connected with the electrical connector in a manner of being pressed against the second connecting element. The illuminating device manufactured according to the method of assembling the illuminating device of the present invention has a more compact structure and good integrity, and is easy to assemble such that the manufacture cost of the illuminating device is lower.

BRIEF DESCRIPTION OF THE DRAWINGS

The accompanying drawings constitute a part of the present description and are used to provide further understanding of the present invention. Such accompanying drawings illustrate the embodiments of the present invention and are used to describe the principles of the present invention together with the description. In the accompanying drawings the same components are represented by the same reference numbers. As shown in the drawings.

DETAILED DESCRIPTION OF THE EMBODIMENTS

Figure 1:
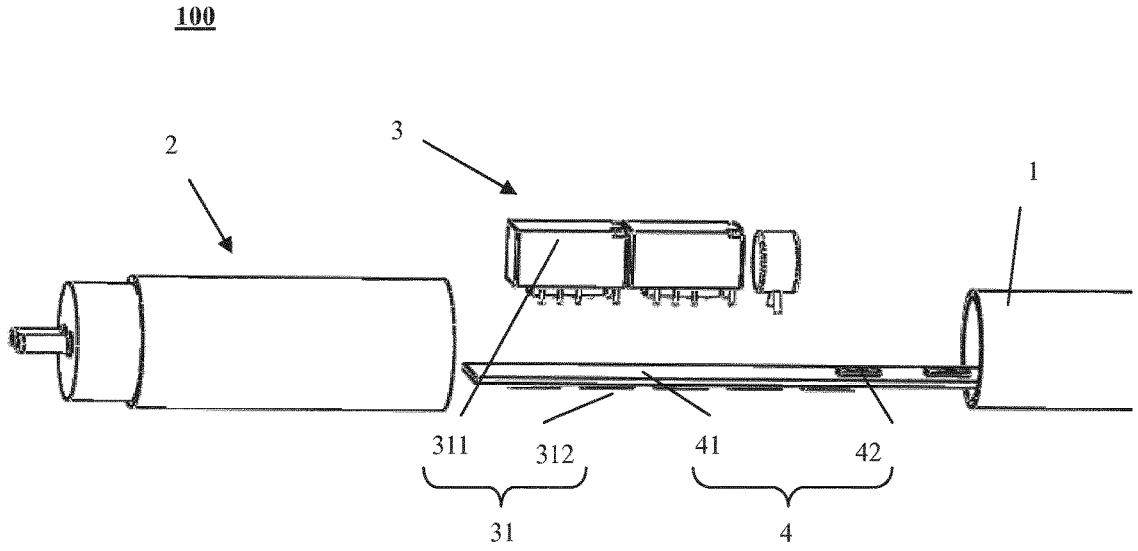
FIG. 1 shows an exploded schematic diagram of an illuminating device according to an embodiment of the present invention.

FIG. 1 shows an exploded schematic diagram of an illuminating device 100 according to an embodiment of the present invention. The illuminating device 100 according to the present invention comprises a tubular casing 1, an electrical connector 2 which can be sheathed to the casing 1 and connected with the casing 1, a light-emitting unit 4 partially arranged in the casing 1, and a drive unit 3 at least partially arranged in the electrical connector 2. The illuminating device 100 according to the present invention can be preferably implemented as a tubular illuminating device, for example, preferably implemented as a T5 LED lamp tube. However, a person skilled in the art should know that the illuminating device 100 according to the present invention also can be implemented as LED lamp tubes with other tube diameters. The light-emitting unit 4 of the illuminating device 100 according to the present invention can comprise a carrier 41 which for example is designed as a circuit board and light-emitting parts 42 arranged and mounted on one side of the carrier 41. Light from the light-emitting parts 42 exits through the casing 1. The drive unit 3 of the illuminating device 100 according to the present invention comprises electronic parts 31, wherein the electronic parts 31 are also arranged on the carrier 41 of the light-emitting unit 4. Thus, the drive unit 3 and the light-emitting unit 4 share one and the same carrier 41.

The drive unit 3 of the illuminating device 100 according to the present invention comprises a first type of parts 311 with a relatively big volume and a second type of parts 312 with a relatively small volume compared with the first type of parts 311, wherein all of the first type of parts 311 and the second type of parts 312 are mounted on the carrier 41. Preferably, the first type of parts 311 and the second type of parts 312 can be arranged on different sides of the carrier 41, respectively, that is, the first type of parts 311 can be mounted together with the light-emitting parts 42 of the light-emitting unit 4 on a first side of the carrier 41, and the second type of parts 312 can be mounted on a second side of the carrier 41 opposite the first side, alternatively, the second type of parts 312 can be mounted together with the light-emitting parts 42 of the light-emitting unit 4 on the first side of the carrier 41, and the first type of parts 311 can be mounted on the second side of the carrier 41 opposite to the first side. It is unnecessary for the first type of parts 311 and the second type of parts 312 mounted on the carrier 41 to be completely received in the electrical connector 2, but they can be partially received in the casing 1. In this way, preferably, both side faces of the carrier 41 of the light-emitting unit 4 are mounted with the electronic parts 31 of the drive unit 3. For example, the electronic parts 31 with a relatively big volume, e.g. relay and capacitor, can be mounted on one side of the carrier 41 which is the same as the side where the light-emitting parts 42 are located, and the electronic parts 31 with a relatively small volume, e.g. resistor, integrated chip, and inductor, are mounted on the other opposite side.

Figure 2:
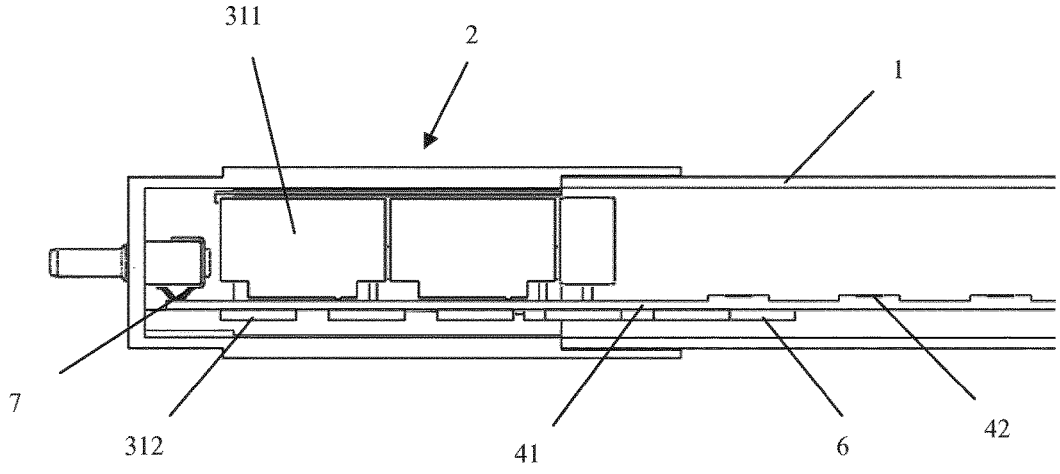
FIG. 2 shows a sectional schematic diagram of the illuminating device according to the embodiment of the present invention.

FIG. 2 shows a sectional schematic diagram of the illuminating device 100 according to the embodiment of the present invention. According to the illuminating device 100 of the present application, the carrier 41 of the light-emitting unit 4 is fixed on an inner wall of the casing 1 by means of a first connecting element 6 which is configured as an adhesive structure, for example, solid glue or the like products. In the installation of the illuminating device 100, upon insertion of the carrier 41 provided with the solid glue into the casing 1, by pressing a part of the carrier 41 exposed from the casing 1, the solid glue on the other part of the carrier 41 located inside the casing 1 is allowed to be adhered to the inner wall of the casing 1. Thus, the light-emitting parts 42 of the light-emitting unit 4 are completely received in the casing 1, the electronic parts 31 of the drive unit 3 with a relatively big volume are still outside the casing 1, but located within the electrical connector 2. After the carrier 41 mounted with the light-emitting parts 42 and the electronic parts 31 for driving the light-emitting parts 42 is fixed in the casing 1, the electrical connector 2 is sheathed to one end of the casing 1, in this way, the carrier 41 is inserted from an opening of the electrical connector 2, and is in electrical contact with the second connecting element 7 mounted within the electrical connector 2. The second connecting element 7 is configured to be capable of elastic deformation, such that the second connecting element 7 can be pressed against the carrier 41 by means of the elastic deformation after the carrier 41 is inserted into the electrical connector 2 and extends to be in contact with the second connecting element 7, thus, electrical connection between the electrical connector 2 and the carrier 41 is formed.

The above is merely preferred embodiments of the present invention but not to limit the present invention. For the person skilled in the art, the present invention may have various alterations and changes. Any alterations, equivalent substitutions, improvements, within the spirit and principle of the present invention, should be covered in the protection scope of the present invention.

LIST OF REFERENCE SIGNS

1 casing
2 electrical connector
3 drive unit
4 light-emitting unit
6 first connecting element
7 second connecting element
41 carrier
42 light-emitting part
31 electronic part
311 first type of part
312 second type of part
100 illuminating device

What is claimed is:

1. An illuminating device comprising:
a tubular casing;
an electrical connector connected with the tubular casing;
a drive unit at least partially received in the electrical connector, wherein the drive unit comprises electronic parts including a first type of parts and a different second type of parts; and
a light-emitting unit received in the tubular casing, wherein the light-emitting unit comprises a carrier and light-emitting parts, wherein the carrier comprises an electrical contact portion configured to be electrically connected with the electrical connector in providing power to at least one of the drive unit and the light-emitting unit;
wherein the electronic parts of the drive unit and the light-emitting parts of the light-emitting unit are arranged on the carrier.

2. The illuminating device according to claim 1, wherein at least one of:
the first type of parts have a greater volume than the second type of parts; and
the first type of parts and the second type of parts are at least partially received in the electrical connector.

3. The illuminating device according to claim 1, wherein:
the first type of parts and the light-emitting parts are mounted on a first side of the carrier; and
the second type of parts are mounted on a second side of the carrier opposite to the first side.

4. The illuminating device according to claim 1, wherein:
the second type of parts and the light-emitting parts are mounted on a first side of the carrier; and
the first type of parts are mounted on a second side of the carrier opposite to the first side.

5. The illuminating device according to claim 1, wherein the illuminating device further comprises a first connecting element arranged on the carrier for fixing one side of the carrier on an inner wall of the tubular casing.

6. The illuminating device according to claim 5, wherein the first connecting element is configured as an adhesive structure, wherein the adhesive structure connects the other side of the carrier which is opposite to the one side mounted with the light-emitting parts on the inner wall.

7. The illuminating device according to claim 5, wherein the illuminating device further comprises a second connecting element arranged within the electrical connector for electrically connecting the carrier and the electrical connector via the electrical contact portion of the carrier.

8. The illuminating device according to claim 7, wherein the second connecting element is pressed against the carrier at the electrical contact portion in an elastic deformable manner to form electrical connection of the electrical connector and the carrier.

9. The illuminating device according to claim 1, wherein:
the first type of parts comprises at least one of a relay and a capacitor; and
the second type of parts comprises at least one of a resistor, an integrated chip, and an inductor.

10. A method for assembling the illuminating device according to claim 1, the method comprising:
providing the carrier for the light-emitting parts of the light-emitting unit of the illuminating device;
arranging the electronic parts of the drive unit of the illuminating device on the carrier;
inserting the carrier mounted with the light-emitting parts and the electronic parts into the tubular casing of the illuminating device, and fixing the carrier on an inner wall of the tubular casing using a first connecting element; and
mounting the electrical connector of the illuminating device on the tubular casing such that the carrier is inserted into the electrical connector and is electrically connected with the electrical connector in a manner of being pressed against a second connecting element.

11. The illuminating device according to claim 1, wherein the illuminating device further comprises a connecting element which connects a side of the carrier which is opposite to a side of the carrier mounted with the light-emitting parts on an inner wall of the tubular casing.

12. The illuminating device according to claim 11, wherein the connecting element connects the side of the carrier which is opposite to the side of the carrier mounted with the light-emitting parts directly on the inner wall of the tubular casing.

13. The illuminating device according to claim 11, wherein only the connecting element connects the side of the carrier which is opposite to the side of the carrier mounted with the light-emitting parts on the inner wall of the tubular casing.

14. The illuminating device according to claim 1, wherein the first type of parts and the second type of parts are arranged on opposite sides of the carrier.

15. The illuminating device according to claim 3, wherein the light-emitting parts are mounted in a space defined by the first type of parts and the tubular casing.

16. The illuminating device according to claim 15, wherein a predetermined distance of the light-emitting parts to a light exit surface of the tubular casing is provided.

17. The illuminating device according to claim 4, wherein the light-emitting parts are mounted in a space defined by the second type of parts and the tubular casing.

18. The illuminating device according to claim 17, wherein a predetermined distance of the light-emitting parts to a light exit surface of the tubular casing is provided.

19. The illuminating device according to claim 1, wherein the illuminating device further comprises a connecting element arranged within the electrical connector for electrically connecting the carrier and the electrical connector via the electrical contact portion of the carrier, wherein the connecting element is pressed against the carrier at the electrical contact portion in an elastic deformable manner to form electrical connection of the electrical connector and the carrier on a side of the carrier opposite to the side of the carrier mounted with the first type of parts of the drive unit.

20. The illuminating device according to claim 1, wherein the illuminating device further comprises a connecting element arranged within the electrical connector for electrically connecting the carrier and the electrical connector via the electrical contact portion of the carrier, wherein the connecting element is pressed against the carrier at the electrical contact portion in an elastic deformable manner to form electrical connection of the electrical connector and the carrier on a side of the carrier opposite to the side of the carrier mounted with the second type of parts of the drive unit.

* * * * *